US005456106A

United States Patent [19]

Harvey et al.

[11] Patent Number: 5,456,106

[45] Date of Patent: Oct. 10, 1995

[54] MODULAR MEASUREMENT WHILE DRILLING SENSOR ASSEMBLY

[75] Inventors: Peter Harvey, Houston, Tex.; Alexander Baues, Bannetxe, Germany

[73] Assignee: Baker Hughes Incorporated, Houston, Tex.

[21] Appl. No.: 212,230

[22] Filed: Mar. 14, 1994

Related U.S. Application Data

[63] Continuation-in-part of Ser. No. 60,563, May 12, 1993, Pat. No. 5,325,714.

[51] Int. Cl.[6] ..... E21B 7/08; E21B 49/00

[52] U.S. Cl. ..... 73/153; 175/40; 175/50; 250/254

[58] Field of Search ..... 73/153; 175/40, 175/45, 50; 250/254

[56] References Cited

U.S. PATENT DOCUMENTS

| | | | |
|---|---|---|---|
| 4,492,276 | 1/1985 | Kamp | 175/61 |
| 4,578,675 | 3/1986 | MacLeod | 340/855 |
| 4,684,946 | 8/1987 | Issenmann | 340/855 |
| 4,697,651 | 10/1987 | Dellinger | 175/61 |
| 4,852,399 | 8/1989 | Falconer | 73/151.5 |
| 5,064,006 | 11/1991 | Waters et al. | 175/45 |
| 5,163,521 | 11/1992 | Pustanyk et al. | 175/40 |
| 5,325,714 | 7/1994 | Lende et al. | 73/153 |

*Primary Examiner*—Hezron E. Williams
*Assistant Examiner*—J. David Wiggins
*Attorney, Agent, or Firm*—Fishman, Dionne & Cantor

[57] ABSTRACT

A modular measurement while drilling sensor assembly is presented. A typical cross-over assembly for mating with a measurement while drilling (MWD) tool is connected to a typical positive displacement mud motor (e.g., a Moineau motor). A modular sensor assembly comprises two portions, an upper drive shaft portion which includes a flexible shaft connected to the motor and a lower sensor portion and supported by a radial bearing. The lower end of the flexible shaft is connected to a hollowed shaft which extends beyond the lower end of the upper drive shaft portion and which is supported by a radial bearing. The lower sensor portion has a central channel extending longitudinally therethrough, with the lower portion of the hollowed shaft extending through this channel. The sensor portion may comprise any type of MWD sensor, however the present invention is preferably used with sensors (e.g., formation evaluation sensors) that benefit from obtaining measurements close to the bit. The lower end of the hollowed shaft is supported with a radial bearing and connected to a flexible shaft of an adjustable kick off assembly connected to the sensor portion. The adjustable kick off assembly allows the introduction of a kick off angle, generally between 0° and 3°, in the assembly. The adjustable kick off assembly is connected to a typical bearing pack assembly. The lower end of the bearing pack assembly is typically connected to a drive shaft, a bit box and then the bit.

20 Claims, 3 Drawing Sheets

MODULAR MEASUREMENT WHILE DRILLING SENSOR ASSEMBLY

This is a continuation-in-part of U.S. patent application Ser. No. 08/060,563 to Bjorn Lende et al filed May 12, 1993, now U.S. Pat. No. 5,325,714, entitled Steerabie Motol System With Integrated Formation Evaluation Logging Capacity.

BACKGROUND OF THE INVENTION

The present invention relates to a measurement while drilling sensor assembly. More particularly, the present invention relates to a modular measurement while drilling sensor assembly for use with a downhole drilling device.

Downhole drilling devices of the positive displacement type are well known. For example, U.S. Pat. No. 5,135,059, which is assigned to the assignee hereof and the disclosure of which is incorporated herein by reference, discloses a downhole drill which includes a housing, a stator having a helically contoured inner surface secured within the housing and a rotor having a helically contoured exterior surface disposed within the stator. Drilling fluid (e.g., drilling mud) is pumped through the stator which causes the rotor to move in a planetary type motion about the inside surface of the stator. A drive shaft is connected to the rotor via a flexible coupling to compensate for eccentric movement of the rotor. Other examples of downhole drilling devices are disclosed in U.S. Pat. Nos. 4,729,675, 4,982,801 and 5,074,681 the disclosure of each of which are incorporated herein by reference.

Formation evaluation tools assist operators in identifying the particular geological material through which a drill is passing. This feedback of information is used by operators to direct the drilling of a well, through, in the case of a horizontal well, a desired layer or stratum without deviating therefrom. These tools have employed several techniques in the past which have been used independently and/or in some combination thereof. Formation resistivity, density and porosity logging are three well known techniques. One resistivity measuring device is described in U.S. Pat. No. 5,001,675 which is assigned to the assignee hereof and is incorporated herein by reference. This patent describes a dual propagation resistivity (DPR) device having one or more pairs of transmitting antennas spaced from one or more pairs of receiving antennas. Magnetic dipoles are employed which operate in the mf and lower hf spectrum. In operation, an electromagnetic wave is propagated from the transmitting antenna into the formation surrounding the borehole and is detected as it passes by the two receiving antennas. The phase and the amplitude are measured in a first or far receiving antenna which is compared to the phase and amplitude received in a second or near receiving antenna. Resistivities are derived from the phase differences and the amplitude ratio of the receiving signals. The formation evaluation of DPR tool communicates the resistivity data and then transmits this information to the drilling operator using mud pulse telemetry. Other examples of DPR units are disclosed in U.S. Pat. Nos. 4,786,874, 4,575,681 and 4,570,123.

Formation density logging devices, such as that described in U.S. Pat. No. 5,134,285 which is assigned to the assignee hereof and the disclosure of which is incorporated herein by reference, typically employ a gamma ray source and a detector. In use, gamma rays are emitted from the source, enter the formation to be studied, and interact with the atomic electrons of the material of the formation and the attenuation thereof is measured by the detector and from this the density of the formation is determined.

A formation porosity measurement device, such as that described in U.S. Pat. No. 5,144,126 which is assigned to the assignee hereof and fully incorporated herein by reference, include a neutron emission source and a detector. In use, high energy neutrons are emitted into the surrounding formation and the detectors measure neutron energy depletion due to the presence of hydrogen in the formation. Other examples of nuclear logging devices are disclosed in U.S. Pat. Nos. 5,126,564 and 5,083,124.

In directional drilling (e.g., a horizontal well), it is desired to maintain the wellbore within the pay zone (i.e., a selected bed or stratum) for as long as possible since the desired raw material may be laterally displaced throughout the strata. Therefore, a higher recovery of that material occurs when drilling laterally through the stratum. The drill bit is typically steered through the pay zone by alternately rotating and sliding the drill string assembly and bit into a different direction. However, the distance between the DPR sensor and the bit requires the wellbore to be drilled at a minimal angle with respect to the longitudinal direction of the pay-zone, otherwise the drill bit may enter a different zone long before the DPR sensor would recognize that fact. In the situation where the adjacent zone includes water, a potential problem becomes more readily apparent.

In drilling apparatus all three of these tools for evaluating a formation may be employed downhole in a drill housing or segment. The most effective at determining whether there is a change in strata ahead of the drill bit, e.g., oil water contact, is the resistivity change of 100 ohms per meter away from the low resistance side of the contact point. However, in the past, excessive spacing between the resistivity measuring (or logging) device and the bit prevented accurate readings as previously discussed. Unfortunately, the resistivity measuring device could not be located close to the bit because of the use of conventional mud motors and stabilization displacing the resistivity sensor twenty-five feet from the bit at minimum.

SUMMARY OF THE INVENTION

The above-discussed and other drawbacks and deficiencies of the prior art are overcome or alleviated by the modular measurement while drilling sensor assembly of the present invention. In accordance with the present invention, a typical cross-over assembly for mating with a measurement while drilling (MWD) tool (e.g., a mud pulse telemetry) is connected to a typical positive displacement mud motor (e.g., a Moineau motor). The motor comprises a housing with a stator having a helically contoured inner surface and a rotor having a cooperating helically contoured outer surface. A modular sensor assembly comprises two portions, an upper drive shaft portion which includes a flexible shaft connected to the motor and a lower sensor portion. It is preferred that all shaft connections be a spline connection, as is known. The lower end of the flexible shaft is connected to a hollowed shaft which extends beyond the lower end of the upper drive shaft portion and is supported by a radial bearing. The lower sensor portion has a central channel extending longitudinally therethrough, with the lower portion of the hollowed shaft extending through this channel. The sensor portion may comprises any type of MWD sensor, however the present invention is preferably use with sensors (e.g., formation evaluation sensors) that benefit from obtaining measurements close to the bit. In the prior art, the MWD sensors were disposed above the motor (when a motor is employed, e.g., directional drilling) which results in the sensor being located further from the bit. Communication between the sensor portion and the other MWD devices, e.g., a mud pulse telemetry device (or any other data storage or other telemetry type device) is accomplished by means of a conductive wire disposed within a channel which extends through the cross-over assembly, the motor assembly and the upper drive shaft assembly. The conductive wire terminates at each end with a known type electrical connector built into the corresponding assembly. The lower end of the hollowed shaft is supported with a radial bearing and connected to a flexible shaft of an adjustable kick off assembly connected to the sensor portion. The adjustable kick off assembly allows the introduction of a kick off angle, generally between 0° and 3°, in the assembly. This is a well known method of direction drilling or steering of the drill bit. The adjustable kick off assembly is connected to a typical bearing pack assembly. The lower end of the bearing pack assembly is typically connected to a drive shaft, a bit box and then the bit.

A cross-over adjustable kick off assembly is used in place of the above described adjustable kick off assembly to provide a direct connection between the motor and the adjustable kick off assembly. This direct connection is desired when drilling operations do not require the aforementioned sensor assembly of the present invention.

The modular capability of the sensor and drilling motor assemblies is an important feature of the present invention. Typically, MWD tools and drilling motors have significantly different maintenance cycles, costs, and failure mechanisms. By making the MWD tool (i.e., the sensor assembly) modular for connection within of the downhole motor assembly, not only are measurements taken closer to the drill bit but equipment utilization levels are maximized by allowing for rigsite replacement of worn/damaged modular tool assemblies. Therefore, by utilizing the maximum useful life of the MWD tool and the drilling motor substantial cost savings are realized over integrated systems. For these reasons the modular concept of the present invention is believed to provide significant benefits over the integral sensor and motor assembly disclosed in U.S. patent application Ser. No. 08/060,563.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIGS. 2A–B are views of the modular sensor in FIGS. 1A–D wherein FIG. 2A is a partly cross sectional side elevation view thereof and FIG. 2B is an end view thereof.

DESCRIPTION OF THE PREFERRED EMBODIMENT

Figures 1A, 1B:
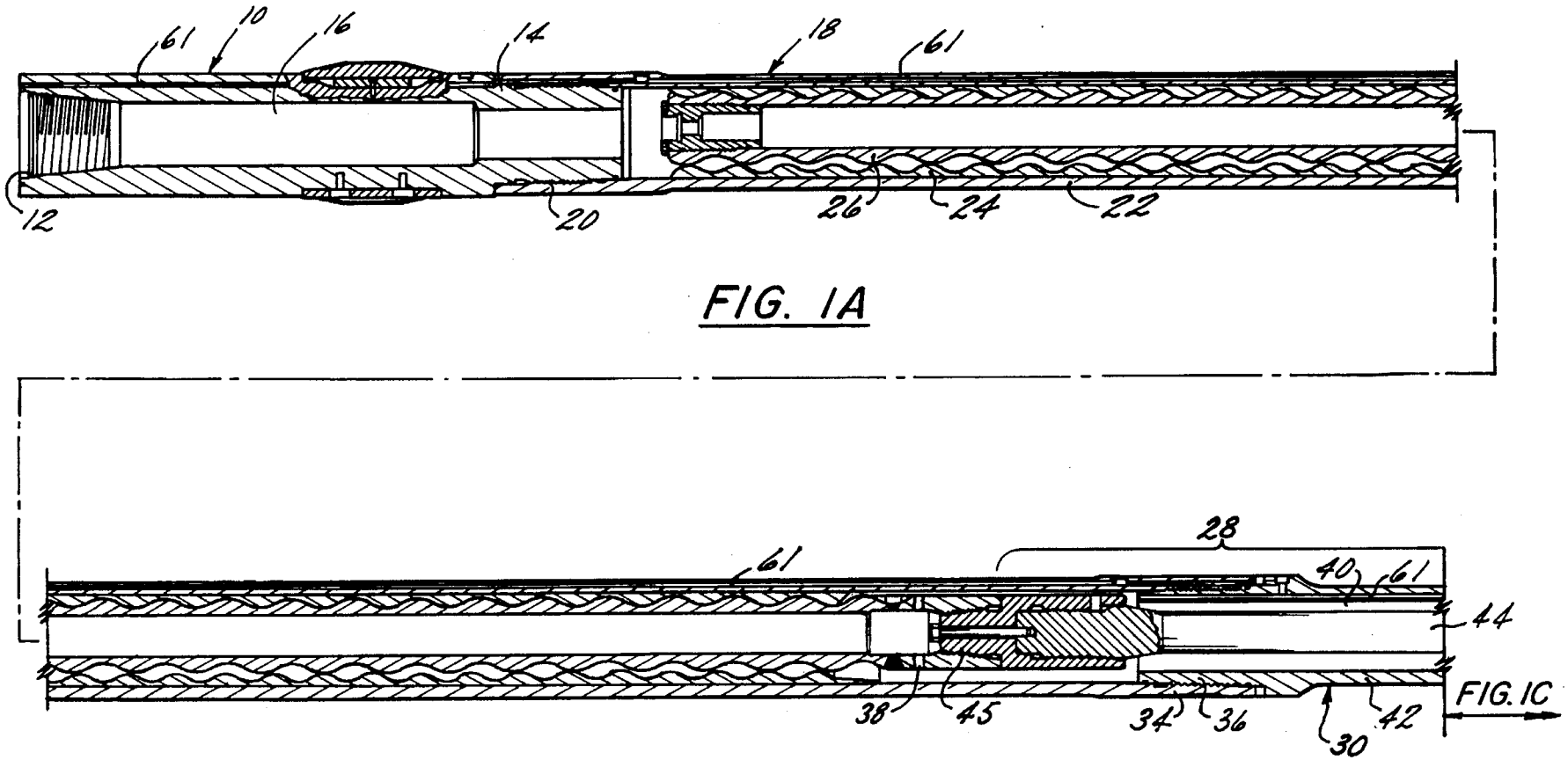
FIGS. 1A–D are a cross sectional side elevation view of a mud motor assembly with a modular measurement while drilling sensor assembly in accordance with the present invention.
Figure 1C:
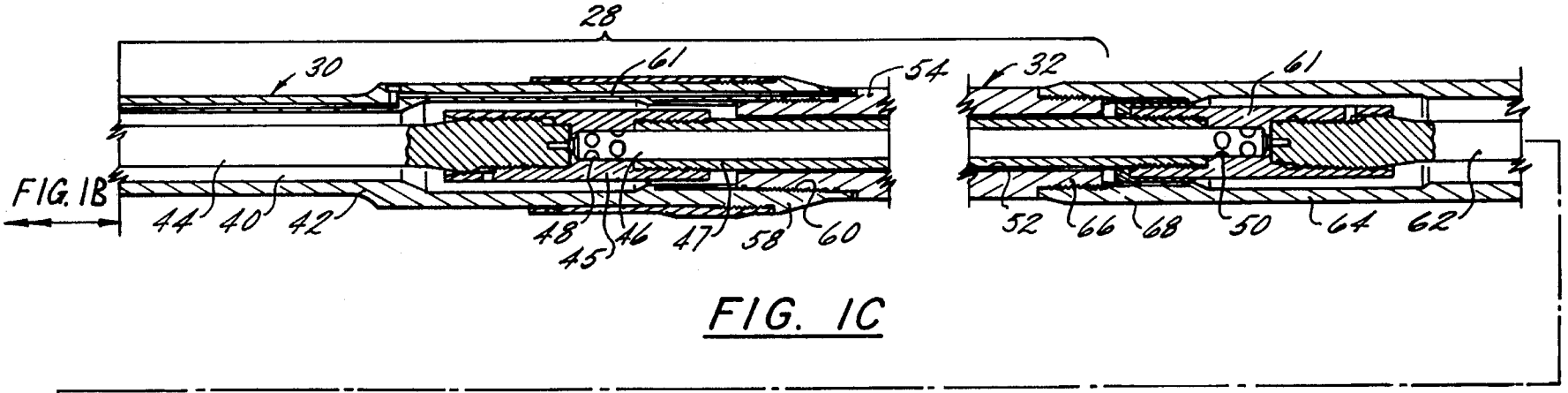
Figure 1D:
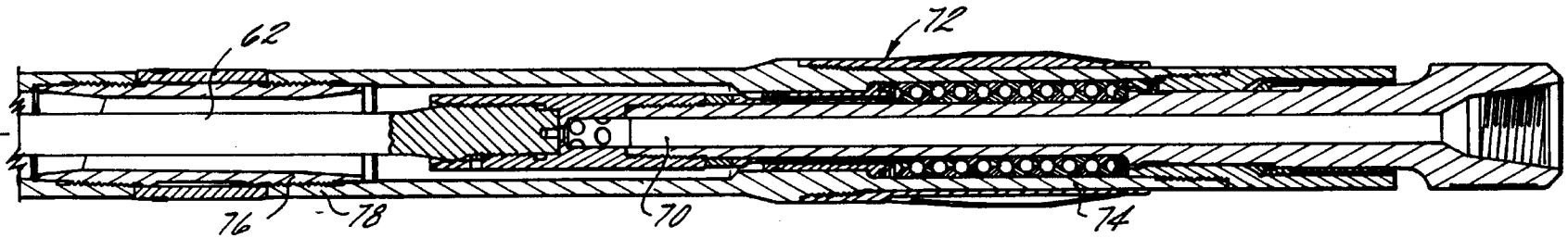

Referring to FIGS. 1A–D, a cross-over assembly 10 has a rotary coupling 12 for mating with a measurement while drilling (MWD) tool (e.g., a mud pulse telemetry, not shown) at one end and a rotary coupling 14 at the other end, with a mud flow channel 16 extending longitudinally through about the center of cross-over assembly 10. A positive displacement mud motor 18 (e.g., a Moineau motor, the positive displacement motor described in U.S. Pat. No. 5,135,059, or any other suitable motor) is connected at one end thereof to cross-over assembly 10. More specifically, rotary coupling 14 of cross-over assembly 10 is connected to a rotary coupling 20 of motor 18. Motor 18 comprises a housing 22, a stator 24 and a rotor 26. Stator 24 has a helically contoured inner surface and rotor 26 has a cooperating helically contoured outer surface, as is clearly shown in the FIGURES and is known.

Figure 2A:
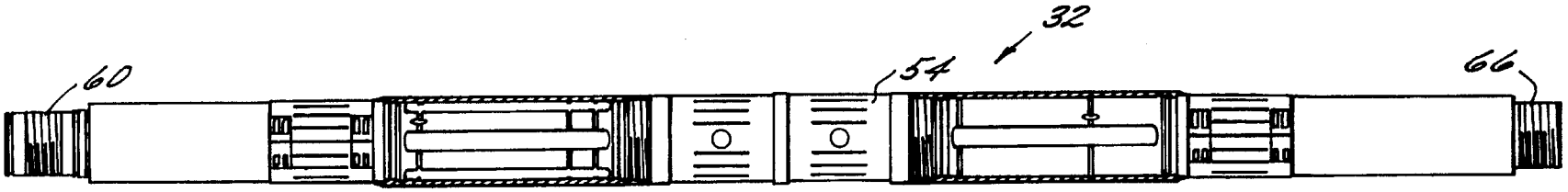

A modular sensor assembly 28 comprises two portions, an upper drive shaft portion 30 which includes a flexible shaft connection and a lower sensor housing portion 32 (FIG. 2A). Modular sensor assembly 28 is connected at one end thereof to motor 18. More specifically, a rotary coupling 34 of motor 18 is connected to a rotary coupling 36 of portion 30. A channel 38 is provided at the lower or downhole end of motor 18 to direct the flow of mud to a channel 40 of portion 30. Portion 30 comprises an outer housing 42 with channel 40 extending longitudinally therethrough. A flexible shaft 44 is connected at the upper end thereof to a coupling 45 attached at the lower end of rotor 26 for rotating therewith. It is preferred that the connection of shaft 44 and rotor 26 be a splined connection, as is known. The lower end of shaft 44 is connected to a coupling 45 at the upper end of a hollowed shaft 47 for rotation therewith. Shaft 47 has upper and lower vent holes 48, 50 respectively, to allow drilling mud to flow from channel 40 through a channel 46 in shaft 47. Shaft 47 extends beyond the lower end of housing 42. Sensor housing portion 32 has a central channel 52 longitudinally therethrough, with the lower portion of shaft 47 extending through channel 52. Portion 32 has an outer housing 54 the upper end of which is connected to the lower end of housing 42. More specifically, a rotary coupling 58 of housing 42 is connected to a rotary coupling 60 of housing 54. Hollow shaft 47 is required to transfer the rotational forces downhole and to provide a path (i.e., channel 46) for the flow of drilling mud. Sensor portion 32 may comprises any type of MWD sensor, however the present invention is preferably used with sensors that benefit from obtaining measurements close to the bit, as it is readily apparent that the MWD sensor is much closer to the bit than the prior art. In the prior art, the MWD sensors were disposed above the motor (when a motor is employed, e.g., directional drilling) which results in the sensor being located further from the bit.

Communication between sensor portion 32 and the aforementioned MWD devices, i.e., the mud pulse telemetry device (or any other data storage or other telemetry type device) is accomplished by means of a conductive wire disposed within a channel 61 which originates in the housing of cross-over assembly 10 and continues discretely through housings 22 and 42. The conductive wire terminates at each end with a known type electrical connector built into the corresponding housing. It will be appreciated that communication may be accomplished by way of electromagnetic wave transmission, such as is described in U.S. Pat. No. 5,160,925 entitled Short Hop Communication Link For Downhole MWD System, which is incorporated herein by reference, or in any other suitable manner.

The lower end of shaft 47 is connected by a coupling 45 to a flexible shaft 62 for rotation therewith. Shaft 62 is disposed within a housing 64 of an adjustable kick off assembly 65 which is connected at its upper end to the lower end of portion 32. More specifically, a rotary coupling 66 of housing 54 is connected to a rotary coupling 68 of housing 64. Housing 64 is an adjustable kick off housing, which allows the introduction of a kick off angle, generally between 0° and 3°, in the assembly. This is a well known method of direction drilling or steering of the drill bit. Shaft 62 is connected to a shaft 70 of a bearing pack assembly 72. Bearing pack assembly has an outer housing 74 which is connected at its upper end to the lower end of housing 64 by rotary couplings 76 and 78 respectively. As mentioned hereinabove, it is preferred that all shaft interconnections (including couplings) described herein comprise splined shaft connections. The lower end of bearing pack assembly 72 is typically connected to a drive shaft housing 75 with a bit box 76 and then the bit (which is not shown but is well known in the art).

It will be appreciated that cross-over assembly 10, motor 18 and bearing pack assembly 72 are all well known devices in the art. The adjustable kick off assembly 65 is also a well known device in the art, however it has been modified at is upper end to accept sensor assembly 28 by extending the upper portion of housing 64, as is clearly shown in FIG. 1C. Due to this modification, the adjustable kick off assembly cannot be directly connected to motor 18, as in the prior art. Accordingly, a cross-over adjustable kick off assembly of the type shown in FIG. 3 and described hereinafter is used in place of the above described adjustable kick off assembly 65 to provide a direct connection between the motor and the adjustable kick off assembly. This direct connection is desired when drilling operations do not require the aforementioned sensor assembly of the present invention.

The modular capability of the sensor and drilling motor assemblies is an important feature of the present invention. Typically, MWD tools and drilling motors have significantly different maintenance cycles, costs, and failure mechanisms. By making the MWD tool (i.e., the sensor assembly) modular for connection within of the downhole motor assembly, not only are measurements taken closer to the drill bit but equipment utilization levels are maximized by allowing for rigsite replacement of worn/damaged modular tool assemblies. Therefore, by utilizing the maximum useful life of the MWD tool and the drilling motor substantial cost savings are realized over integrated systems. For these reasons the modular concept of the present invention is believed to provide significant benefits over the integral sensor and motor assembly disclosed in U.S. patent application Ser. No. 08/060,563.

Figure 2B:
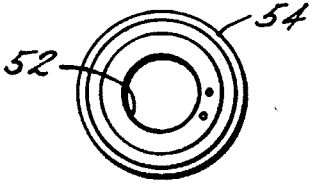

Referring to FIGS. 2A–B, sensor housing portion 32 comprises housing 54 having rotary couplings 60 and 66 at each end thereof with channel 52 extending longitudinally therethrough. Channel 52 must be of a diameter sufficient for accepting shaft 47 therein and to allow for rotation of shaft 47. By way of example, portion 32 is a electromagnetic resistivity tool of a type well known in the art (e.g., the aforementioned DPR tool). However, it will be appreciated that any type of MWD tool (formation evaluation tool) may be employed, providing that shaft 47 and channel 52 are properly configured, without departing from the spirit or scope of the present invention.

Figure 3:
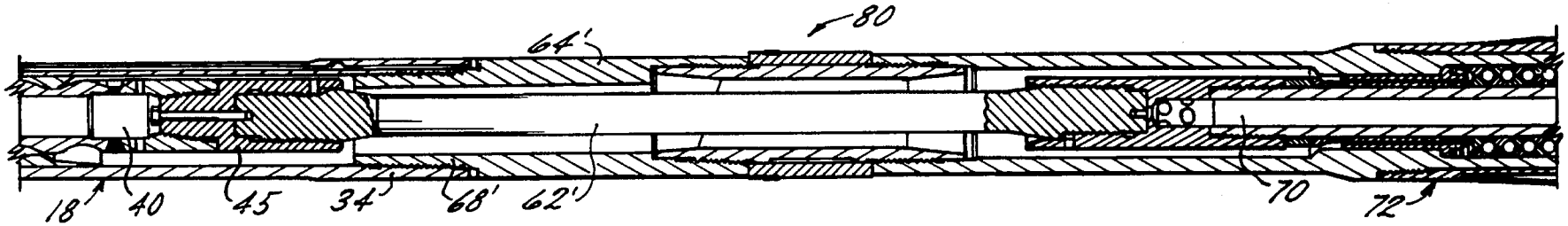
FIG. 3 is a cross section side elevation view of a cross-over adjustable kick off assembly for use with the mud motor of FIGS. 1A–D.

Referring to FIG. 3, the aforementioned cross-over adjustable kick off assembly for use with the above described motor assembly when the sensor is not employed is shown generally at 80. Assembly 80 replaces assemblies 28 and 65. Assembly 80 is shown in FIG. 3 connected between motor 18 and bearing pack assembly 72. Accordingly, rotary coupling 34 of motor 18 is connected to a rotary coupling 68' of assembly 80. A flexible shaft 62 is connected at the upper end thereof to a coupling 45 attached at the lower end of rotor 26 for rotating therewith. It is preferred that the connection of shaft 44 and rotor 26 be a splined connection, as is known. Shaft 62 is disposed within a housing 64' of cross-over adjustable kick off assembly 80 which is connected at its lower end to the upper end of bearing pack assembly 72. The adjustable kick off assembly allows the introduction of a kick off angle, generally between 0° and 3°, in the assembly. Again, this is a well known method of direction drilling or steering of the drill bit. Shaft 62 is connected to shaft 70 of bearing pack assembly 72. As mentioned hereinabove, it is preferred that all shaft interconnections (including couplings) described herein comprise splined shaft connections.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A down hole assembly comprising:

a mud motor comprising:

(a) a motor housing having first and second opposed ends, (b) a stator disposed in said motor housing, and (c) a rotor disposed in said motor housing for cooperating with said stator to generate rotary forces;

a modular sensor assembly comprising, (a) a sensor housing having an axial opening therethrough, said sensor housing having first and second opposed ends, said first end of said sensor housing removably connected to said second end of said motor housing, (b) a sensor disposed at said sensor housing, (c) a shaft housing having an axial opening therethrough, said shaft housing having first and second opposed ends, said first end of said shaft housing connected to said second end of said sensor housing, and (d) a first shaft supported within said axial opening of said shaft housing and extending from said shaft housing at said second end thereof, said first shaft extending through said axial opening in said sensor housing, said first shaft having first and second opposed ends, said first end of said first shaft removably connected to said rotor; and a bearing pack comprising, (a) a bearing housing having an axial opening therethrough, said bearing housing having first and second opposed ends, said first end of said bearing housing removably connected to said second end of said shaft housing, and (b) a second shaft supported within said axial opening of said bearing housing, said bearing housing having first and second opposed ends, said first end of said second shaft removably connected to said second end of said first shaft, and said second end of said second shaft for communicating rotary forces to a drill bit.

2. The assembly of claim 1 wherein said sensor comprises:

a formation evaluation sensor.

3. The assembly of claim 1 further comprising:

a device for communicating between said sensor and a tool located up hole of said mud motor.

4. The assembly of claim 3 wherein said device for communicating comprises:

a wire connecting said sensor to the tool located up hole of said mud motor for communicating therebetween.

5. The assembly of claim 4 further comprising:

a channel extending through said motor housing and said shaft housing to said sensor housing.

6. The assembly of claim 3 wherein said device for communicating comprises:

an electromagnetic telemetry device for communication between said sensor and the tool located up hole of said mud motor.

7. The assembly of claim 1 further comprising:

an adjustable kick off assembly having a housing with a first end thereof removably connected to said second end of said shaft housing and a second end thereof connected to said first end of said bearing housing, said adjustable kick off assembly for introducing a kick off angle in said down hole assembly.

8. The assembly of claim 7 wherein said kick off angle is between about 0° and about 3°.

9. The assembly of claim 1 wherein said first end of said first shaft is removably connected to said rotor by a flexible interconnection.

10. The assembly of claim 1 wherein:

said stator comprises a helically grooved inner surface; and said rotor comprises a grooved outer surface adapted to rotate about the inside surface of said stator in response to a flow of drilling mud therethrough.

11. A down hole assembly comprising:

a mud motor comprising, (a) a motor housing having first and second opposed ends, (b) a stator disposed in said motor housing, and (c) a rotor disposed in said motor housing for cooperating with said stator to generate rotary forces;

a modular sensor assembly comprising, (a) a sensor housing having an axial opening therethrough, said sensor housing having first and second opposed ends, said first end of said sensor housing removably connected to said second end of said motor housing, (b) a sensor disposed at said sensor housing, (c) a first shaft supported within said axial opening of said sensor housing, said first shaft having first and second opposed ends, said first end of said first shaft removably connected to said rotor; and a bearing pack comprising, (a) bearing housing having an axial opening therethrough, said bearing housing having first and second opposed ends, said first end of said bearing housing removably connected to said second end of said sensor housing, and (b) a second shaft supported within said axial opening of said bearing housing, said bearing housing having first and second opposed ends, said first end of said second shaft removably connected to said second end of said first shaft, and said second end of said second shaft for communicating rotary forces to a drill bit.

12. The assembly of claim 11 wherein said sensor means comprises:

a formation evaluation sensor.

13. The assembly of claim 11 further comprising:

a device for communicating between said sensor and a tool located up hole of said mud motor.

14. The assembly of claim 13 wherein said device for communicating comprises:

a wire connecting said sensor to the tool located up hole of said mud motor.

15. The assembly of claim 14 further comprising:

a channel extending through said motor housing to said sensor housing.

16. The assembly of claim 13 wherein said device for communicating comprises:

an electromagnetic telemetry device for communication between said sensor and the tool located up hole of said mud motor.

17. The assembly of claim 11 further comprising:

an adjustable kick off assembly having a housing with a first end thereof removably connected to said second end of said sensor housing and a second end thereof connected to said first end of said bearing housing, said adjustable kick off assembly for introducing a kick off angle in said down hole assembly.

18. The assembly of claim 17 wherein said kick off angle is between about 0° and about 3°.

19. The assembly of claim 11 wherein said first end of said first shaft is removably connected to said rotor by a flexible interconnection.

20. The assembly of claim 11 wherein:

said stator comprises a helically grooved inner surface, and said rotor comprises a grooved outer surface adapted to rotate about the inside surface of said stator in response to a flow of drilling mud therethrough.

* * * * *